US005295390A

United States Patent [19]

Hosono

[11] Patent Number: 5,295,390

[45] Date of Patent: Mar. 22, 1994

[54] METHOD OF BURRING

[75] Inventor: Yukihito Hosono, Gifu, Japan

[73] Assignee: Kabushiki Kaisha Toshiba, Kawasaki, Japan

[21] Appl. No.: 13,151

[22] Filed: Feb. 1, 1993

Related U.S. Application Data

[63] Continuation of Ser. No. 704,311, May 22, 1991, abandoned.

[30] Foreign Application Priority Data

May 25, 1990 [JP] Japan ..... 2-136407

[51] Int. Cl.[5] ..... B21D 22/00

[52] U.S. Cl. ..... 72/334; 72/358

[58] Field of Search ..... 72/334, 333, 329, 326, 72/330, 348, 352, 354.2, 354.6, 355.2, 356, 358

[56] References Cited

U.S. PATENT DOCUMENTS

| | | | |
|---|---|---|---|
| 1,048,046 | 12/1912 | Currey | 72/334 |
| 1,695,476 | 12/1928 | Winkler | 72/334 |
| 1,699,361 | 1/1929 | Karmazin | 72/334 |
| 2,070,784 | 2/1937 | Cox | 72/334 |
| 2,909,281 | 10/1959 | Koskinen | 72/355.2 |
| 3,365,926 | 1/1968 | Price | 72/358 |
| 3,399,560 | 9/1968 | Connolly et al. | 72/334 |
| 3,719,068 | 3/1973 | Hashimoto et al. | 72/334 |
| 3,771,480 | 11/1973 | Johnson | 72/358 |
| 4,400,965 | 8/1983 | Schey | 72/334 |
| 5,159,826 | 11/1992 | Miyazawa et al. | 72/358 |

FOREIGN PATENT DOCUMENTS

| | | | |
|---|---|---|---|
| 0082225 | 5/1985 | Japan | 72/334 |
| 0538767 | 12/1976 | U.S.S.R. | 72/348 |
| 0724264 | 3/1980 | U.S.S.R. | 72/333 |

*Primary Examiner*—Lowell A. Larson
*Assistant Examiner*—Michael J. McKeon
*Attorney, Agent, or Firm*—Limbach & Limbach

[57] ABSTRACT

A method of burring includes a first step of forming, in a metal plate, a bottomed expanded portion expanded into a die hole with a punch and a die having the die hole into which the punch is inserted, the die hole being formed such that a predetermined gap is formed between an inner peripheral face of the die hole and an outer peripheral face of the punch so as to have a width larger than a thickness of the metal plate, a second step of swaging the bottom of the expanded portion of the metal plate between the punch and the bottom face of the die hole to render the bottom of the expanded portion thinner such that a material of the expanded portion bottom is caused to flow to a peripheral wall portion of the expanded portion positioned in the gap between the inner peripheral face of the die hole and the outer peripheral face of the punch, thereby thickening the peripheral wall portion of the expanded portion, and a third step of opening the bottom of the expanded portion.

4 Claims, 4 Drawing Sheets

METHOD OF BURRING

This is a continuation of application Ser. No. 07/704,311, filed on May 22, 1991, now abandoned.

BACKGROUND OF THE INVENTION

This invention relates to a method of burring for forming a generally short cylindrical projected burr on workpieces such as a metal plate.

In a conventional burring method, a circular prepared hole is formed by way of punching. The peripheral portion of the prepared hole is formed into a cylindrical configuration by way of drawing so that a short cylindrical burr is formed. A tapping screw is usually threaded into the burr formed as described above in order that another part or member is secured to the metal plate.

In the above-described conventional method, however, the metal plate needs to be extended by way of drawing so that the burr is formed. Accordingly, the peripheral portion of the burr has a thickness smaller than the base metal plate, which often causes the thickness of the burr peripheral portion to be smaller than the depth of the screw thread. In such a case the screw needs to be replaced with one having a smaller depth of the screw thread. Consequently, a sufficient screw tightening force cannot be obtained, resulting in insufficient securing of the other part or member to the metal plate.

SUMMARY OF THE INVENTION

Therefore, an object of the present invention is to provide a method of burring wherein the thickness of the burr peripheral wall portion can be rendered larger than or can be approximated to that of the metal plate on which the burr is formed.

The present invention provides a method of burring comprising a first step of forming, in a metal plate, a bottomed sleeve portion expanded into a die hole of a die by means of a punch which is inserted into the die hole, the die hold being dimensioned such that a predetermined gap is formed between an inner peripheral face of the die hole and an outer peripheral face of the punch so that the gap has a width larger than a thickness of the metal plate, and a second step of swaging the bottom of the sleeve portion of the metal plate between the punch and the bottom face of the die hole to render the bottom of the sleeve portion thinner such that the material of the sleeve portion bottom is caused to flow to a peripheral wall portion of the sleeve portion positioned in the gap between the inner peripheral face of the die hole and the outer peripheral face of the punch, thereby thickening the peripheral wall portion of the sleeve portion and simultaneously with the swaging of the bottom of the sleeve portion, swaging the metal plate at the top peripheral portion of the sleeve portion adjacent to the rising peripheral wall of the sleeve portion, between a circular projected edge of the die hole and either a stepped face of the punch or a holder moved together with the punch to hold the metal plate between the circular projected edge of the die hole and the holder, such that the material of the metal plate swaged therebetween is allowed to flow to the peripheral wall portion of the sleeve portion positioned in the gap between the inner peripheral face of the die hole and the outer peripheral wall portion of the punch.

In accordance with the above-described method, the bottom of the sleeve portion of the metal plate is swaged between the punch and the bottom face of the die hole. The swaging pressure causes the material of bottom of the sleeve portion to flow to the peripheral wall portion of the sleeve portion. Consequently, the thickness of the burr peripheral wall portion can be rendered larger than or can be approximated to that of the metal plate on which the burr is formed.

Other objects of the invention will become obvious upon understanding of the illustrative embodiment about to be described or will be indicated in the appended claims. Various advantages not referred to herein will occur to one skilled in the art upon employment of the invention in practice.

DESCRIPTION OF THE PREFERRED EMBODIMENT

An embodiment of the present invention will be described with reference to FIGS. 1 to 5.

Figure 1:
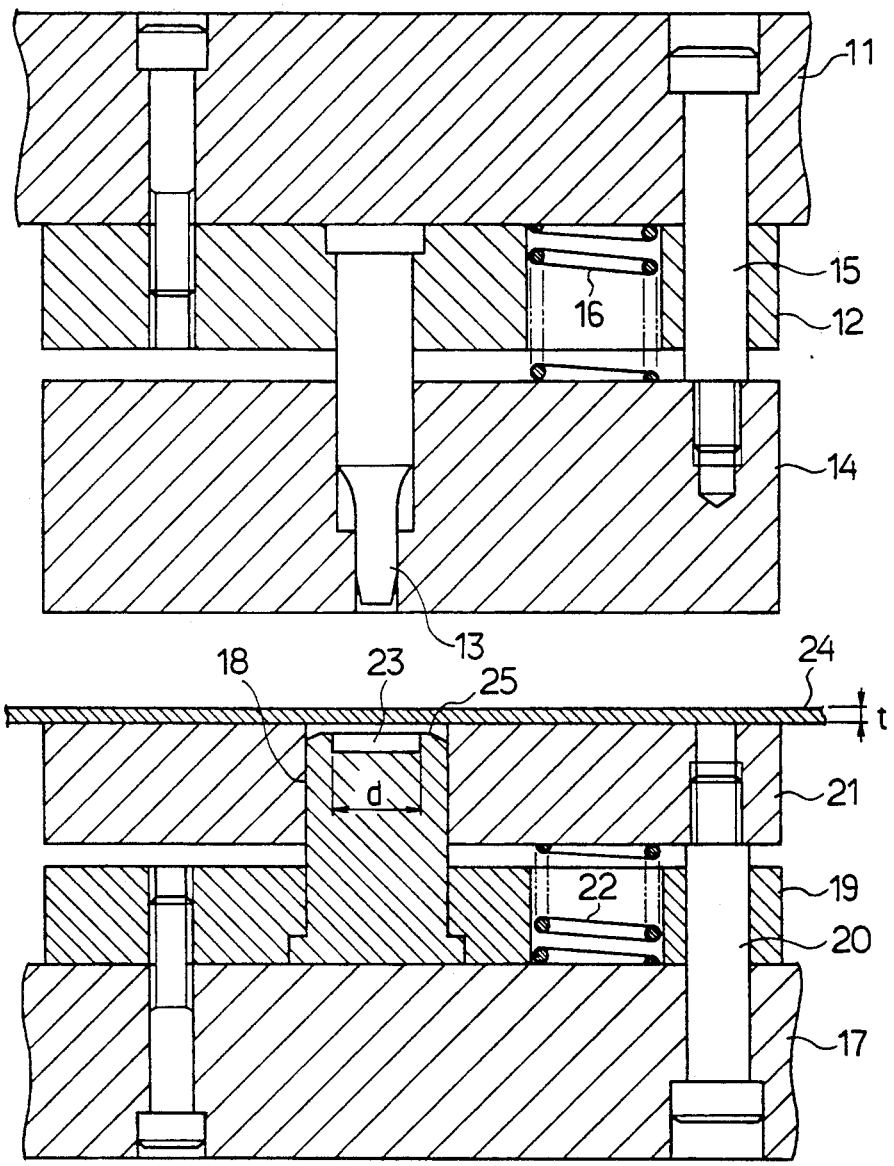
FIG. 1 is a partially longitudinal side sectional view of a press machine used to put into practice the method in accordance with the present invention.

FIG. 1 illustrates a press die employed in accordance with the method of the present invention. A punch holder 11 is mounted on a ram (not shown) of a press machine. A punch 13 is secured to the punch holder 11 by a punch plate 12. An upper blank holder 14 is mounted on a guide pin 15 secured to the punch holder 11 so as to be vertically moved. The upper blank holder 14 is usually urged downwards by a plurality of compression coil springs 16 (one of them being shown in FIG. 1) provided between the punch holder 11 and the upper blank holder 14 so that the underside of the upper blank holder 14 is positioned slightly lower than the lower end of the punch 13.

A die holder 17 is mounted on a bed (not shown) of the press machine. A die 18 is secured to the die holder 17 by a die plate 19. A lower blank holder 21 is mounted on a guide pin 21 secured to the die holder 17 so as to be vertically moved. The lower blank holder 21 is usually urged upwards by a plurality of compression coil springs 22 (one of them being shown in FIG. 1) provided between the die holder 17 and the lower blank holder 21 so that the top of the lower blank holder 21 is positioned slightly over the top of the die 18. The spring force of each compression coil spring 22 of the lower blank holder 21 is set to a value smaller than that of each compression coil spring 16 of the upper blank holder 14.

A shallow die hole 23 is formed in the top of the die 18. The inner diameter d of the die hole 23 is set to such a value that a gap G (see FIG. 2) is defined between the inner peripheral face of the die hole 23 and the outer peripheral face of the punch 13 when the lower end of the punch 13 is penetrated into the die hole 23, the gap G having a width larger than the thickness t of the metal plate 24 to be burred.

Figure 2:
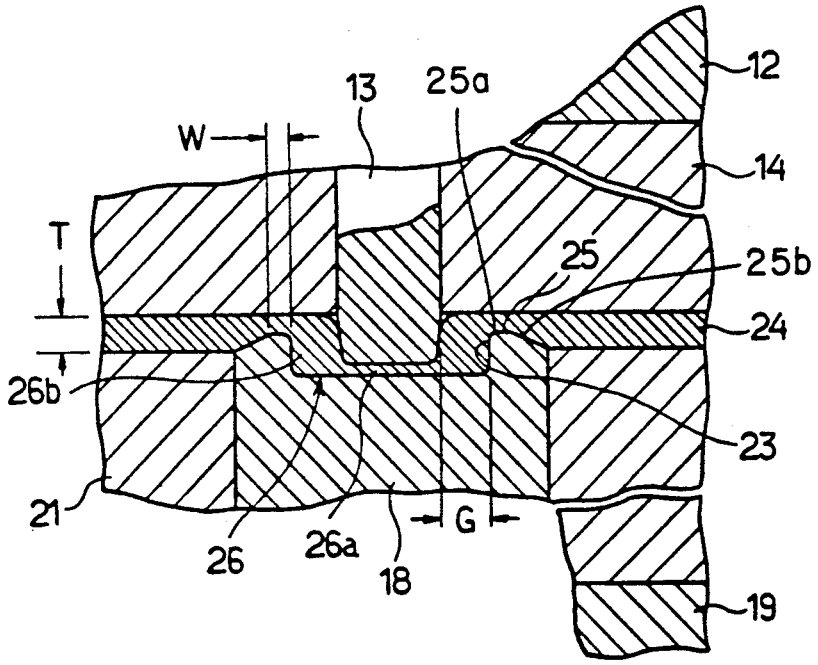
FIG. 2 is a partially enlarged longitudinal section of the press machine in the condition that the swaging is being performed by a press die.

As shown in FIG. 2 the top of the die 18 has a generally circular or annular projection edge 25. This annular projection has two distinct parts. The first is a flat, annular edge face 25*a* which is generally perpendicular to the inner peripheral face of die hole 23. The second annular part is a downwardly inclined portion 25*b*. The width or radial dimension of the inner peripheral face 25*a* is indicated as "w" in FIG. 2. The width of metal plate 24 is indicated in FIG. 2. As can be seen, the width of the projected edge face, w, is smaller than the thickness T of the metal plate 24.

A procedure for burring the metal plate 24 with the above-described press die will now be described.

Figure 3:
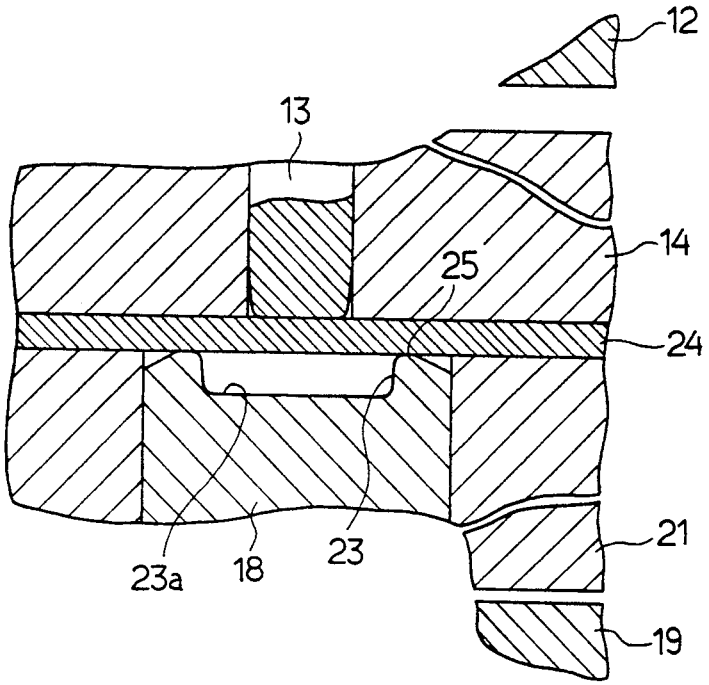
FIGS. 3 and 4 are partially enlarged longitudinal sections of the press machine showing the process steps before the swaging, respectively.
Figure 4:
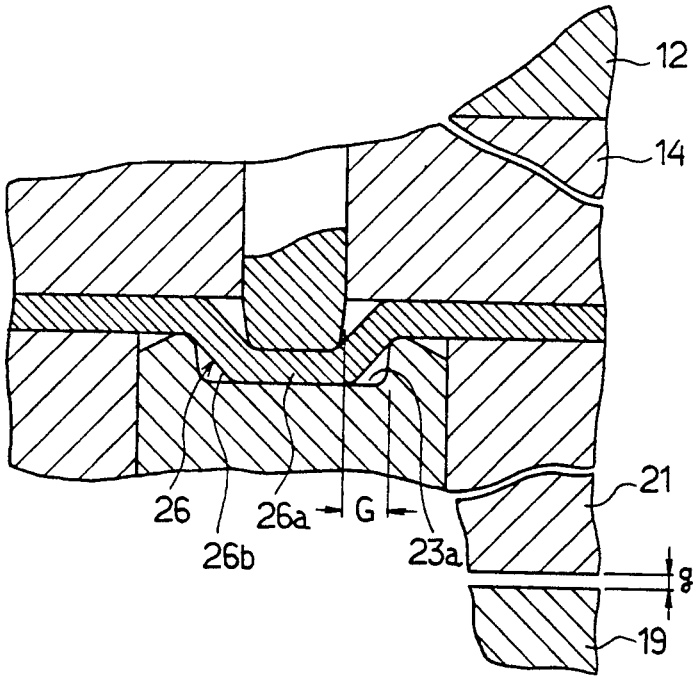

The metal plate 24 is placed on the lower blank holder 21 and then, the ram of the press machine is lowered, as shown in FIG. 1. The upper blank holder 14 then strikes the metal plate 24 such that it is held between the upper and lower blank holders 14, 21. With the subsequent lowering of the press machine ram, the upper blank holder 14 presses down the lower blank holder 21 together with the metal plate 24 against the spring force of each compression coil spring 22 since the spring force is set to the value smaller than that of each spring coil 16. The pressing force of the upper blank holder 14 is received by the die 18 when the metal plate 24 pressed down together with the lower blank holder 21 strikes the upper end of the die annular projection 25, as shown in FIG. 3. The lowering of the upper blank holder 14 is interrupted in this condition. Accordingly, with further subsequent lowering of the press machine ram, the punch holder 11 is lowered with each compression coil spring 16 contracted such that the punch 13 is moved downwards relative to the upper blank holder 14. Consequently, the punch 13 strikes the metal plate 24 as shown in FIG. 3 and further is projected from the upper blank holder 14 such that it is forced to enter the die hole 23 as shown in FIG. 4. Thus, with cooperation with the die 18, the punch 13 deforms the portion of the metal plate 24 surrounded by the annular projection 25 of the die 18 such that the portion is projected into the die hole 23 as shown in FIG. 4, thereby forming a tapered, bottomed sleeve portion 26 (a first stage). The peripheral portion of the sleeve portion 26 is prevented from corrugating since the metal plate 24 is held between the upper and lower blank holders 14, 21 during the formation of the expanded portion 26.

The punch plate 12 strikes the upper blank holder 14 when the bottom 26*a* of the work portion 26 is projected to the bottom face 23*a* of the die hole 23, as shown in FIG. 4. Subsequently, the press machine ram is lowered by a predetermined amount or an amount corresponding to the gap G between the lower blank holder 21 and the die plate 19 in FIG. 4. Then, the upper blank holder 14 and the punch 13 are integrally pressed downwards such that the bottom 26*a* of the sleeve portion 26 is pressed between the punch 13 and the bottom face 23*a* of the die hole 23 to be thereby swaged and the upper peripheral edge portion of the sleeve portion 26 of the metal plate 24 is pressed between the upper blank holder 14 and the annular projection 25 of the die 18 to be thereby swaged, as shown in FIG. 2 (a second stage). Consequently, the bottom 26*a* and the upper peripheral edge of the sleeve portion 26 are thinned. When the swaging is started, there are spaces between the inner face of the peripheral wall 26*b* of the sleeve portion 26 and the outer peripheral face of the punch 13 and between the outer face of the peripheral wall 26*b* of the portion 26 and the inner peripheral face of the die hole 23, as shown in FIG. 4. Consequently, with the subsequent progress of the swaging, materials of the bottom 26*a* and the upper outer peripheral edge portion of the sleeve portion 26 are caused to flow to the peripheral wall 26*b* of the sleeve portion 26. As the result of such a material flow, the gap G is filled with the peripheral wall 26*b* such that the peripheral wall 26*b* is thickened and the sleeve portion 26 is formed into a cylindrical shape, as shown in FIG. 2.

In the above-described second step, the swaging between the upper blank holder 14 and the annular projection 25 of the die hole 23 prevents the peripheral wall 26*b* of the expanded portion 26 from escaping toward the open end of the die hole 23. This effect of prevention is further improved by the fact that the metal plate 14 is held between the upper and lower blank holders 14, 21.

The press machine ram is raised after the peripheral wall 26*b* of the sleeve portion 26 is thickened as described above. Then, the punch 13 is raised relative to the upper blank holder 14 pressing the metal plate 24 against the lower blank holder 21 by way of the spring force of each compression coil spring 16, thereby escaping from the sleeve portion 26. Subsequently, the upper blank holder 14 is raised and the lower blank holder 21 pushes the metal plate 24 upwards with the rising of the upper blank holder 14 such that the sleeve portion 26 is pulled out of the die hole 23. Consequently, the press machine is returned to the initial state as shown in FIG. 1.

Subsequently, the metal plate 24 is detached from the lower blank holder 21 and the bottom 26*a* of the sleeve portion 26 is opened (a third stage). In this stage, the bottom 26*a* of the sleeve portion 26 may be punched with a known punch die or may be cut with a conventional drill.

Figure 5:
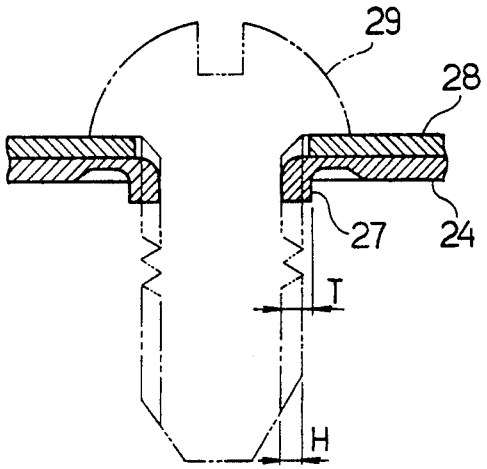
FIG. 5 is an enlarged longitudinal section of a burr and another member secured to the burr with a screw.

The burr 27 is thus formed in the metal plate 24 as shown in FIG. 5. The peripheral wall of the short cylindrical burr 27 has the thickness larger than the metal plate 24 as the result of the material flow at the time of swaging by the pressing die. Consequently, when a screw 29 is to be screwed into the metal plate 24 for the purpose of securing another member 28, the screw 29 can be tightened sufficiently since the thickness T of the burr 27 is larger than the depth of the screw thread of the screw 29, as shown in FIG. 5. Accordingly, no problem arises about securing of the other member 28.

Figure 6:
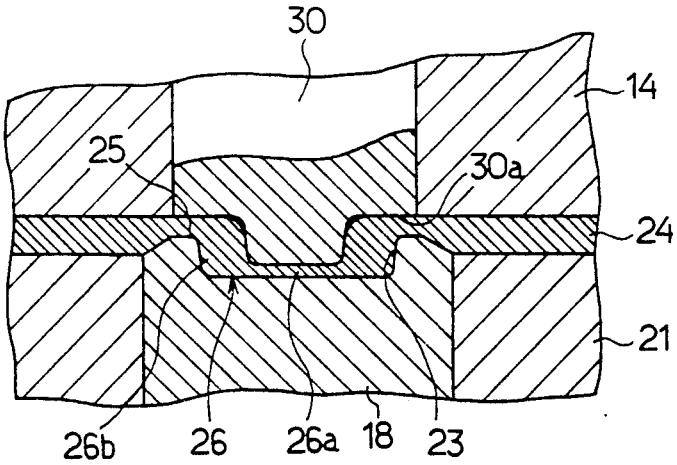
FIG. 6 is a view similar to FIG. 2 showing a modified form of the press die employed in accordance with the method of the invention.

Although the upper outer peripheral edge of the sleeve portion 26 is swaged between the upper blank holder 14 and the annular projection 25 of the die 18 in the foregoing embodiment, the punch 30 may be provided with a step as shown in FIG. 6 and the upper outer peripheral edge of the sleeve portion 26 may be swaged between a step face 30*a* of the punch 30 and the annular projection 25.

The foregoing disclosure and drawings are merely illustrative of the principles of the present invention and are not to be interpreted in a limiting sense. The only limitation is to be determined from the scope of the appended claims.

I claim:

1. A method of burring comprising:

a first step of forming, in a metal plate, a bottomed sleeve portion expanded into a die hole of a die by means of a punch which is inserted into the die hole, the die hole being formed such that a predetermined gap is formed between an inner peripheral face of the die hole and an outer peripheral face of the punch so that the gap has a width larger than the thickness of the metal plate, the die hole having a peripheral circular projected edge having a projected edge face whose width is smaller than the thickness of the metal plate, and a second step of i) swaging the bottom of the sleeve portion of the metal plate between the punch and the bottom face of the die hole to render the bottom of the sleeve portion thinner such that the material of the sleeve portion bottom is caused to flow to a peripheral wall portion of the sleeve portion positioned in the gap between the inner peripheral face of the die hole and the outer peripheral face of the punch, thereby thickening the peripheral wall portion of the sleeve portion, and ii) swaging the metal plate at the top peripheral portion of the sleeve portion adjacent to the rising peripheral wall of the sleeve portion, between the circular projected edge of the die hole and a holder moved together with the punch, such that the material of the metal plate swaged therebetween is allowed to flow to the peripheral wall portion of the sleeve portion positioned in the gap between the inner peripheral face of the die hole and the outer peripheral wall portion of the punch.

2. A method of burring comprising:

a first step of forming, in a metal plate, a bottomed sleeve portion expanded into a die hole of a die by means of a punch which is inserted into the die hole, the die hole being formed such that a predetermined gap is formed between an inner peripheral face of the die hole and an outer peripheral face of the punch so that the gap has a width larger than the thickness of the metal plate, the die hole having a peripheral circular projected edge having a projected edge face whose width is smaller than the thickness of the metal plate, and a second step i) swaging the bottom of the sleeve portion of the metal plate between the punch and the bottom face of the die hole to render the bottom of the sleeve portion thinner such that the material of the sleeve portion bottom is caused to flow to a peripheral wall portion of the sleeve portion positioned in the gap between the inner peripheral face of the die hole and the outer peripheral face of the punch, thereby thickening the peripheral wall portion of the sleeve portion, and ii) swaging the metal plate at the top peripheral portion of the sleeve portion adjacent to the rising peripheral wall of the sleeve portion, between the circular projected edge of the die hole and a stepped face of the punch such that the material of the metal plate swaged therebetween is allowed to flow to the peripheral wall portion of the sleeve portion positioned in the gap between the inner peripheral face of the die hole and the outer peripheral wall portion of the punch.

3. A method of burring comprising:

a first step of forming, in a metal plate, a bottomed sleeve portion expanded into a die hole of a die by means of a punch held for vertical movement with a vertically movable upper blank holder in cooperation with the die, the die hole having a peripheral circular projected edge having a projected edge face whose width is smaller than the thickness of the metal plate, the die hole being formed such that a predetermined gap is formed between an inner peripheral face of the die hole and an outer peripheral face of the punch so that the gap has a width larger than the thickness of the metal plate, the die being held for vertical movement with a vertically movable lower blank holder so that the metal plate is held between the die and the lowered upper blank holder, and a second step of i) swaging the bottom of the sleeve portion of the metal plate between the punch and the bottom face of the die hole to render the bottom of the sleeve portion thinner such that the material of the sleeve portion bottom is caused to flow to a peripheral wall portion of the sleeve portion positioned in the gap between the inner peripheral face of the die hole and the outer peripheral face of the punch, thereby thickening the peripheral wall portion of the sleeve portion, and ii) swaging the metal plate at the top peripheral portion of the sleeve portion adjacent to the rising peripheral wall of the sleeve portion, between the circular projected edge of the die hole and said upper blank holder moved together with the punch, such that the material of the metal plate swaged therebetween is allowed to flow to the peripheral wall portion of the sleeve portion positioned in the gap between the inner peripheral face of the die hole and the outer peripheral wall portion of the punch.

4. A method of burring comprising:

a first step of forming, in a metal plate, a bottomed sleeve portion expanded into a die hole of a die by means of a punch held for vertical movement with a vertically movable upper blank holder in cooperation with the die, the die hole having a peripheral circular projected edge having a projected edge face whose width is smaller than the thickness of the metal plate, the die hole being formed such that a predetermined gap is formed between an inner peripheral face of the die hole and an outer peripheral face of the punch so that the gap has a width larger than the thickness of the metal plate, the die being held for vertical movement with a vertically movable lower blank holder so that the metal plate is held between the die and the lowered upper blank holder, and a second step of i) swaging the bottom of the sleeve portion of the metal plate between the punch and the bottom face of the die hole to render the bottom of the sleeve portion thinner such that the material of the sleeve portion bottom is caused to flow to a peripheral wall portion of the sleeve portion positioned in the gap between the inner peripheral face of the die hole and the outer peripheral face of the punch, thereby thickening the peripheral wall portion of the sleeve portion, and ii) swaging the metal plate at the top peripheral portion of the sleeve portion adjacent to the rising peripheral wall of the sleeve portion, between the circular projected edge of the die hole and a stepped face of the punch such that the material of the metal plate swaged therebetween is allowed to flow to the peripheral wall portion of the sleeve portion positioned in the gap between the inner peripheral face of the die hole and the outer peripheral wall of the punch.

* * * * *